US009885216B2

(12) United States Patent
Tseytlin et al.

(10) Patent No.: US 9,885,216 B2
(45) Date of Patent: Feb. 6, 2018

(54) ACOUSTIC METHODS AND DEVICES FOR DETERMINING THE VALUE OF FORMATION OVERPRESSURE DURING DRILLING AND FOR DETECTING GAS PACKS CONTAINING HYDROGEN SULFIDE GAS

(71) Applicants: Simon Tseytlin, Middle Village, NY (US); David Tseytlin, Brooklyn, NY (US)

(72) Inventors: Simon Tseytlin, Middle Village, NY (US); David Tseytlin, Brooklyn, NY (US)

( * ) Notice: Subject to any disclaimer, the term of this patent is extended or adjusted under 35 U.S.C. 154(b) by 158 days.

(21) Appl. No.: 15/161,247

(22) Filed: May 22, 2016

(65) Prior Publication Data

US 2017/0009544 A1 Jan. 12, 2017

Related U.S. Application Data

(60) Provisional application No. 62/189,157, filed on Jul. 6, 2015.

(51) Int. Cl.
*E21B 21/08* (2006.01)
*E21B 47/06* (2012.01)

(52) U.S. Cl.
CPC ..... *E21B 21/08* (2013.01); *E21B 47/06* (2013.01)

(58) Field of Classification Search
None
See application file for complete search history.

(56) References Cited

U.S. PATENT DOCUMENTS 8,235,143 B2 * 8/2012 Tseytlin ..... E21B 47/101 175/48

* cited by examiner

*Primary Examiner* — John Fitzgerald
*Assistant Examiner* — Jean Morello
(74) *Attorney, Agent, or Firm* — Boris Leschinsky

(57) ABSTRACT

A method for determining formation pressure during exploratory drilling for oil includes generating a series of negative pressure shock waves at successively increasing well pressures to characterize gas kick forming at the bottom of a well. Once the lower end of the gas kick has been formed, the well pressure level as detected by a pressure sensor near the surface of the well is used to calculate the formation pressure along with the weight of the fluid column located in the well.

10 Claims, 5 Drawing Sheets

ACOUSTIC METHODS AND DEVICES FOR DETERMINING THE VALUE OF FORMATION OVERPRESSURE DURING DRILLING AND FOR DETECTING GAS PACKS CONTAINING HYDROGEN SULFIDE GAS

CROSS-REFERENCE DATA

The present patent application claims priority from a U.S. Provisional Application No. 62/189,157 filed 6 Jul. 2015 with the same title, which is incorporated herein in its entirety by reference.

BACKGROUND OF THE INVENTION

The present invention relates generally to devices and methods for exploration of oil and gas. More particularly, the invention describes how to measure formation pressure and how to detect the presence of hydrogen sulfide gas in a rising gas kick so as appropriate prevention and safety measures can be promptly taken. The present invention can be advantageously used when drilling onshore and offshore oil wells. It is designed to allow prevention of blowouts and well explosions, which usually cause human losses, damage to environment and are hard and expensive to suppress.

During an exploratory drilling of an oil, gas or gas condensate wells, drilling fluid referred to in the industry as "mud", is pumped into the drill pipe. The mud proceeds out through the drill bit and up the annular space between the drill pipe and the walls of the hole. It generally proceeds then further up the annular space between the drill pipe and the casing, after which it returns to the surface of the well. At the surface, the mud is typically examined for certain parameters, processed and returned to the circulation. The purpose of the circulating mud is to clean, cool and lubricate the bit, flush to the surface the cuttings from the bore hole and to protect the walls of the hole until casing is inserted. The density of the mud is carefully controlled at the surface so as to contain various pressures encountered in the hole.

As the well is drilled, gases saturated in highly pressurized fluids at the bottom may be released therefrom or from a porous rock and find their way into the circulating mud forming an annular gas bubble or a gaseous pack, also called a gas kick. This gas kick may ascend to the surface, result in a modification of the buoyancy of the drilling string and can cause extensive damage if it goes undetected. The gas or liquid contained in the gas kick reduces the hydrostatic head in the annulus. If the volume of the gas kick is not excessive and if it can be detected, gas kick removal procedures may be instituted so that drilling operations may proceed with minimal disruption.

Careful monitoring of formation pressure is highly desirable in order to control formation of gas kicks and to assure safe operation of the oil well.

In addition to monitoring for a possible formation and ascendance of a gas kick, containing mostly natural gas, there is an additional safety concern regarding formation of a gas kick containing hydrogen sulfide gas, $H_2S$. This gas is highly toxic, heavier than air, flammable and can cause substantial damage and even death to the oil well service personnel—upon inhaling such gas is extremely irritating and harmful. Free hydrogen sulfide in the blood reduces its oxygen-carrying capacity, thereby depressing the nervous system. Hydrogen sulfide is oxidized quite rapidly to sulfates in the body, therefore no permanent after effects occur in cases of recovery from acute exposures unless oxygen deprivation of the nervous system is prolonged. Effects such as eye irritation, respiratory tract irritation, slow pulse rate, lassitude, digestive disturbances, and cold sweats may occur but these symptoms disappear in a relatively short time after removal from the exposure. At high concentrations of 500 ppm and above, hydrogen sulfide is fatal in as little as 30 minutes.

Surface monitors of hydrogen sulfide presence are not sufficient to assure safety in case of hydrogen sulfide exposure. Methods are needed to warn service personnel about the upcoming gaseous pack containing hydrogen sulfide which will give more time to assure personnel safety than that available with surface monitors.

Using acoustics for detection of the gas kick presence is known in the art. U.S. Pat. No. 4,273,212 for example discloses sending an acoustic pulse down the pipe and receive its reflection in the annular portion of the well head. Using high frequency positive acoustic pulses however does not allow full characterization of the gas kick as it only allows detection of its upper end and not allows detection of its lower end which is needed to detect its total volume.

SUMMARY OF THE INVENTION

Accordingly, it is an object of the present invention to overcome these and other drawbacks of the prior art by providing novel methods and devices that can determine formation overpressure during drilling in case a gas pack starts forming at the bottom hole.

Another object of the invention is to provide methods and devices which can detect a gas pack containing hydrogen sulfide gas as soon as it forms. This is very important in making an informed decision of what countermeasures to deploy in such cases.

The present invention is an improvement of devices shown in the U.S. Pat. No. 8,235,143 entitled "Methods And Devices For Determination Of Gas-Kick Parameters And Prevention Of Well Explosion", which is incorporated herein by reference in its entirety.

This patent describes methods and associated devices designed to detect a gas kick and to determine its parameters such as formation pressure, gas kick content, location, ascending velocity and size, and to estimate the time of its arrival to the surface. Knowing this data is critical in performing a safe washing of the gas pack from the well, and in preventing a full-scale blowout of the well.

Formation pressure is determined by sending repeated acoustic waves (for example using a negative pressure wave) down the bore of the exploratory oil well. Reflected waves are captured and analyzed by a computer. Once the upper end of the forming gas kick is detected, blowout preventer is closed and flow resistance through the side tube (also referred to as a killing tube) is gradually increased so as to raise the pressure in the well. Once the pressure is raised sufficiently to arrest the growth of the gas kick, its lower end forms and can be detected by the respective acoustic signature from the subsequent negative pressure wave. Pressure in the well is then measured and the formation pressure can be calculated with high precision knowing the height of the well and the density of the drilling mud.

Once the formation pressure is established, countermeasures to wash out the gas kick may be taken such as replacing the existing drilling mud with the mud of proper density suitable to (i) keep the gas from forming additional gas kicks while (ii) not exciding safety limits so as to not fracture the well.

The present methods and devices allow to determine the value of formation overpressure quickly and with high precision, which would make performing the above tasks easier and safer.

The presence of hydrogen sulfide is determined by monitoring oil well for sudden appearance of a gas kick starting not from the well bottom but somewhere in the middle. Appearance of a well formed gas kick in the middle portion of the well indicates presence of either hydrogen sulfide or carbon dioxide in the gas kick rather than natural gas. Safety measures may then be taken in order to safely discharge such gas kick without putting personnel at risk. This method allows detecting possible hydrogen sulfide gas kick well in advance of its reaching the surface therefore providing oil rig personnel with more time to react appropriately.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

a. 2*a*—normal operation, no gas kick is detected b. 2*b*—gas kick is detected and is located at the bottom of the well c. 2*c*—gas kick is ascending towards the middle of the well d. 2*d*—gas kick is near the surface of the well

DETAILED DESCRIPTION OF THE PREFERRED EMBODIMENT OF THE INVENTION

Figure 1:
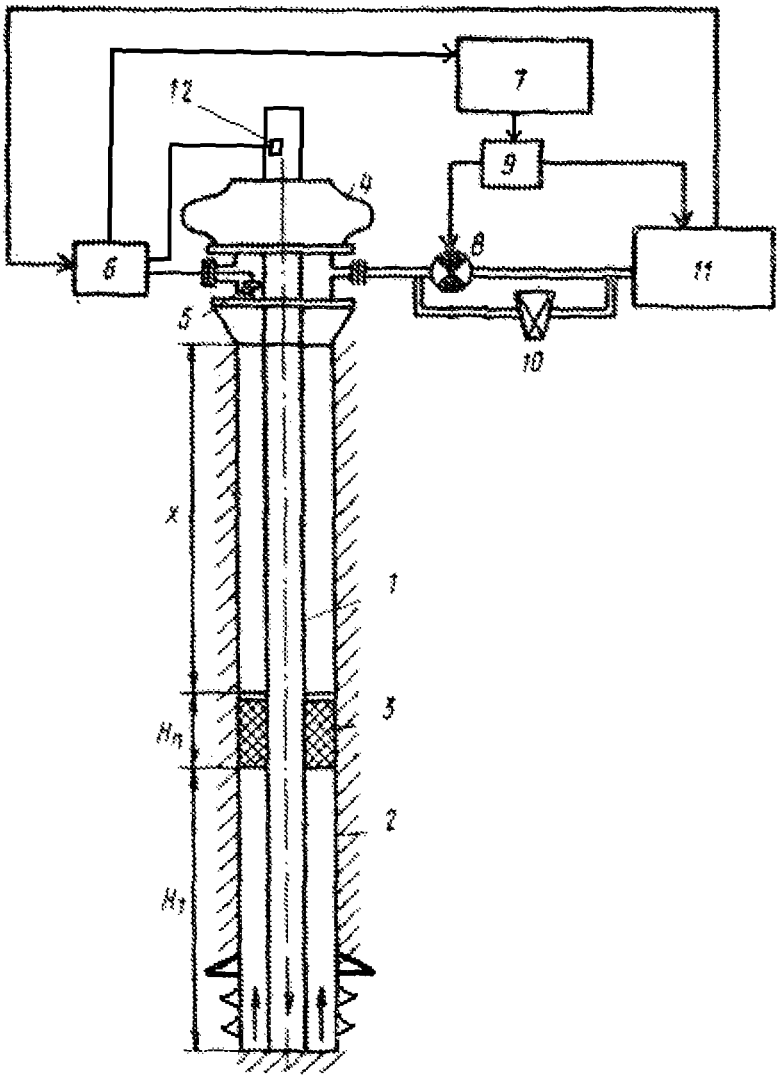
FIG. 1 is a cross-sectional view of the oil well equipped with the device of the present invention.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

A well equipped with the system of the invention is depicted in FIG. 1. It includes a well casing 2 with a drilling pipe 1 located inside and forming an annular space therebetween. The lower end of the well with the drill bit attached to the pipe 1 is not shown. A blowout preventer (BOP) 4 is shown placed on top of the well at the point of a wellhead. An outgoing well pressure sensor 5 may be located in the vicinity of the wellhead outlet allowing monitoring of drilling mud outlet pressure as it leaves the well. The optional incoming pressure sensor 12 may be located at the inlet of the wellhead to monitor inlet pressure of the drilling mud as it is being forced down the drilling pipe 1 by a suitable pump (not shown). The signals from both pressure sensors 5 and 12 may be fed into a data acquisition unit 6, which in turn is connected to a central processing unit (CPU) 7 based for example on a laptop PC.

The gas kick volume in the annular space is shown generally as position 3. It may be characterized by its height Hn, distance from the wellhead X and distance from the reservoir H1.

Other components of the system of the invention may include a fast-acting on/off valve 8 activated by a valve driver 9 based on a control signal from the computerized central processing unit 7. The valve 8 may be preferably located between the drilling mud collecting reservoir 11 and the exit from the annular space of the well or at any other surface location after the exit from the well, for example in a killing tube. In embodiments, valve 8 may also be placed inside the well. Rapid opening and closing of the valve 8 allows reducing abruptly the flow resistance in the outgoing pathway of the drilling mud. In order to not block the flow of drilling mud entirely when the valve 8 is closed, a parallel pathway or a bypass pipe around the valve 8 may be provided which may include a remotely adjustable flow restrictor 10. In other embodiments of the invention (not shown), the valve 8 may include provisions to be rapidly opened and closed but to not completely obstruct the flow of the drilling mud. Such provisions may include an adjustable valve seat (chock). Moving the seat away from the valve stem leaves certain space rendering the valve 8 somewhat incompetent.

The method of the invention describes generating a series of periodic negative pressure waves (impulses) for gas kick characterization in such a manner so as not to confuse generated and reflected pressure wave signals. As a result of valve 8 being abruptly opened, the flow resistance is suddenly reduced causing a rapid drop in mud pressure. This rapid drop generates a negative pressure shock wave, which travels down the annular space of the well with a speed of sound, typically 1200-1500 meters per second. For the purposes of this invention, the change in pressure may be accomplished within a period of time of about 1/20 to about 1 second to generate a crisp rise of the front wave. In embodiments, that range for the drop in pressure may also be about 1/10 to 3/10 of a second. The difference between the initial or first pressure of the fluid in the well (such as drilling mud) and mud pressure after opening of valve 8 may be about 1 to 5 atmospheres. The valve 8 may be kept open to maintain the low mud pressure for a period of time long enough to allow the negative pressure wave to travel down the well and return back up. In some embodiments, this time ranges from about 1 to about 20 seconds, while in other embodiments this time may be from about 5 to about 10 seconds. Deeper wells may require longer opening times, while shorter wells may need shorter times.

Alternatively, an impulse generator may be placed in contact with the drilling mud and used to generate the necessary impulses within the mud. This approach may not be as advantageous as the impulse generator requires a dedicated source of electrical power and also because such impulses may not be strong enough to travel the entire length of the well without significant decay.

Once the shock wave of the reflected pressure wave has reached the surface, its acoustic signature may be recorded using the pressure sensor 5 as a signal P shown in the drawings.

The step of generating a single pressure shock wave may be repeated from time to time to monitor the changing condition of the gas kick in the well. As pressure disturbance from opening the valve 8 may generate multiple reflection waves, repeating the step of generating another negative pressure wave may be done after sufficient time have elapsed from the previous measurement to allow these reflection waves to attenuate and the pressure in the well to stabilize and return to a steady state. In embodiments, such period of time may be about 1 to about 60 minutes, preferably from about 5 to about 30 minutes. Unsteady pressure in the well at the beginning of the process may lead to an erroneous reading.

FIGS. 2*a* to 2*d* are computer-simulated pressure signals from a typical oil well, while FIGS. 3*a* through 3*d* are actual exemplary recordings of such pressure. In addition to the outlet pressure, FIGS. 3*a* to 3*d* show a fluctuating inlet pressure—with periodic increases and decreases of inlet pressure caused by operation of the pump configured to push drilling mud down the oil well.

Figure 2A:
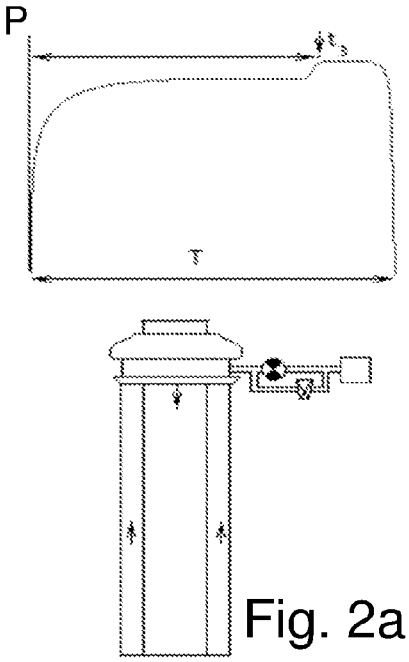
FIGS. 2*a* through 2*d* are various charts of the acoustic signature of the reflected pressure wave resulted from a computer simulations in a variety of circumstances.
Figure 3A:
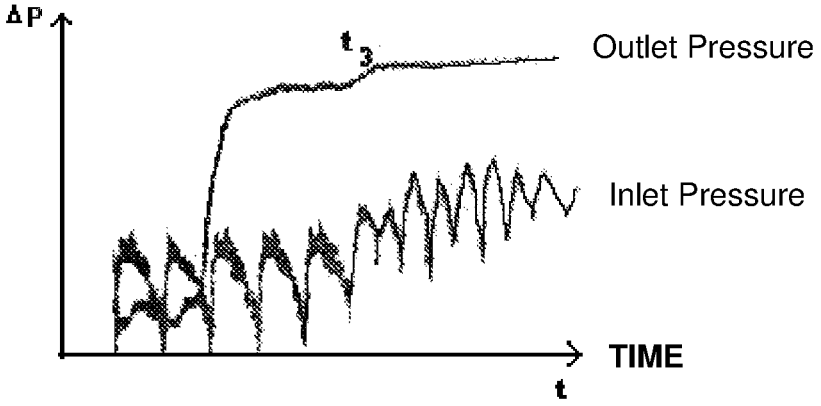
FIGS. 3*a* through 3*d* are examples the same charts—this time actually recorded as a result of an experiment on an exemplary oil well.

Under normal operating conditions without any gas kick present in the system, the typical outlet pressure characteristic of the well is shown in FIGS. 2*a* and 3*a* in which t3 is the time of arrival of the acoustic pressure wave at the bottom of the formation marked by a pressure increase in the P curve.

Figure 2B:
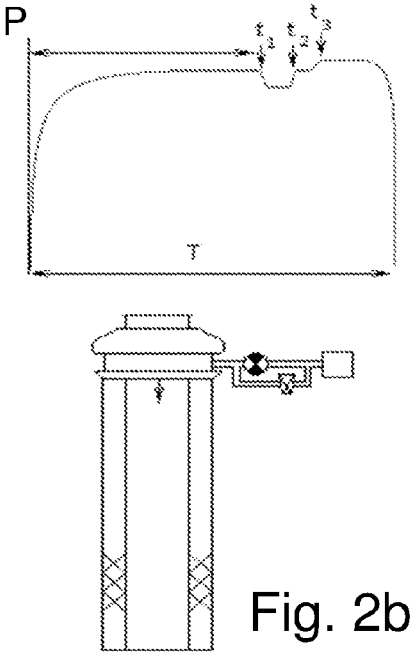
Figure 3B:
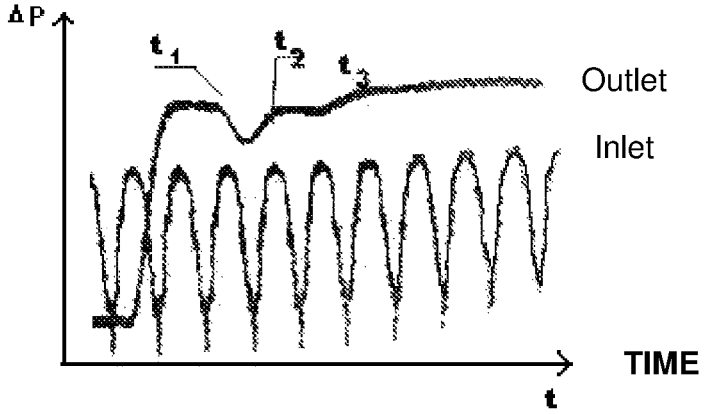

If the pressure wave encounters an ascending gas kick after its formation is complete, two additional pressure disturbances are generated, one at the upper end of the gas kick and one at the lower end of the gas kick. The upper end of the gas kick constitutes a point of t1, or a transition of density from a high level of mud to a low level of gas. The lower end of the gas kick is characterized by the opposite point of t2, or a transition of density from that low of gas to a high density of mud. Data acquisition unit 6 may be configured for automatic detection of the times of arrival of reflected waves t1, t2, and t3. As seen in FIGS. 2*b* and 3*b*, t1 is the time of arrival of the first reflected wave from the upper end of the gas kick; t2 is the time of arrival of the second wave reflected off the lower end of the gas kick, and t3 is the time of arrival of the reflected wave from the well bottom. Transition point from harder or denser medium of the drilling mud to a less dense medium of a gas kick causes a drop in pressure on the pressure curve, while a transition from less dense gas to a more dense mud caused an increase in the pressure.

Figure 2C:
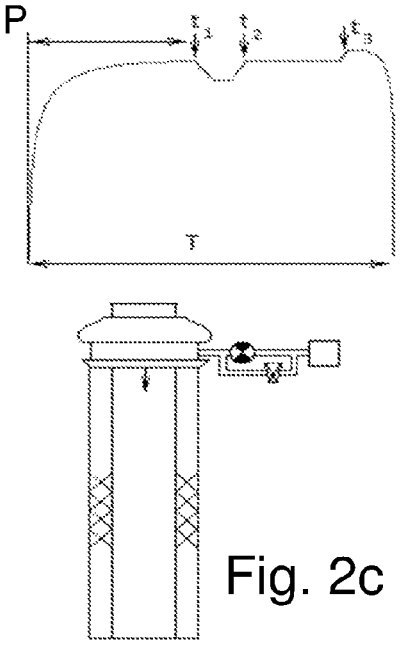
Figure 2D:
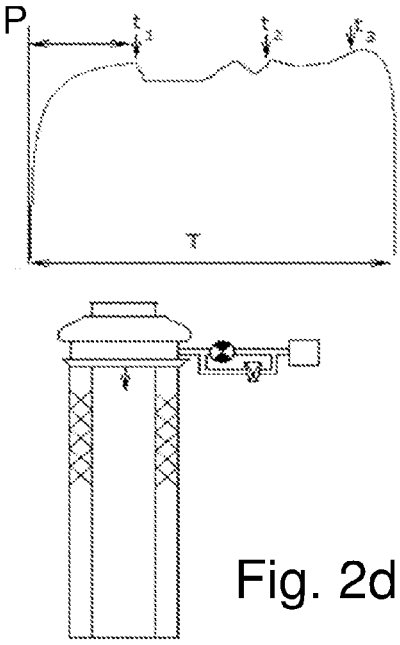
Figure 3C:
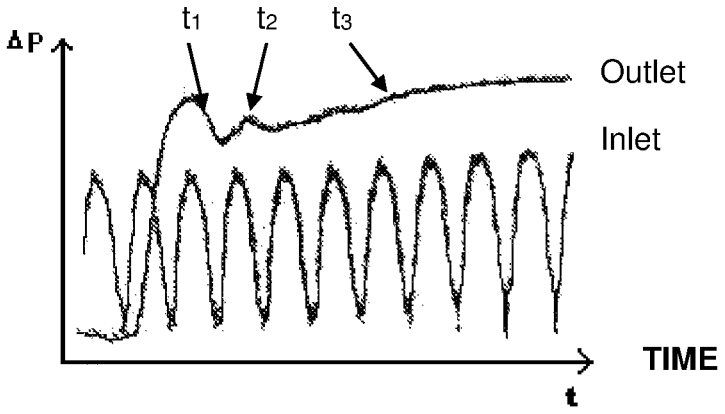
Figure 3D:
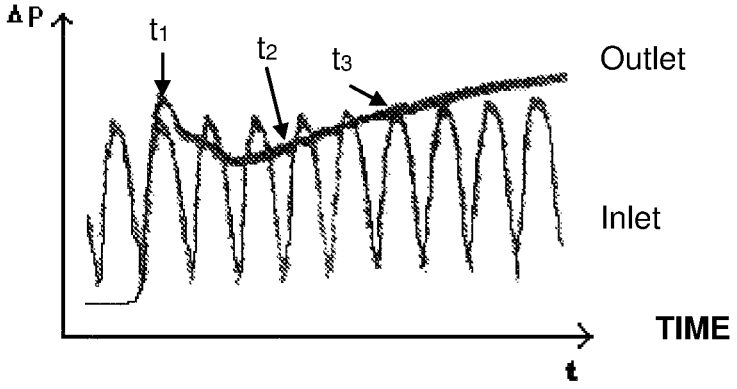

FIGS. 2*c* and 3*c* show examples of a pressure signal indicating ascending of the gas kick along the well, with FIGS. 2*d* and 3*d* showing the gas kick near the surface, as time t1 gets to be shorter as the gas kick ascends towards the surface. This information is critical to estimate the time of arrival of the gas kick so that appropriate safety measures may be undertaken.

Detection of Formation Pressure

Figure 4A:
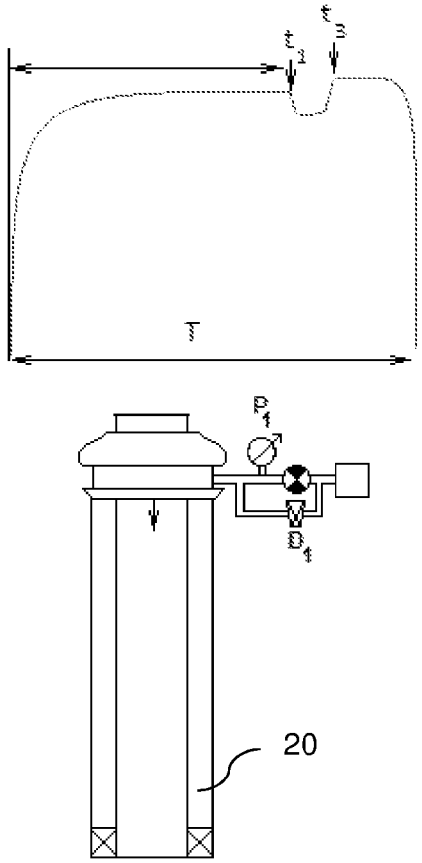
FIGS. 4*a* and 4*b* are examples of computer-generated model signals used to determine formation pressure in the oil well.
Figure 4B:
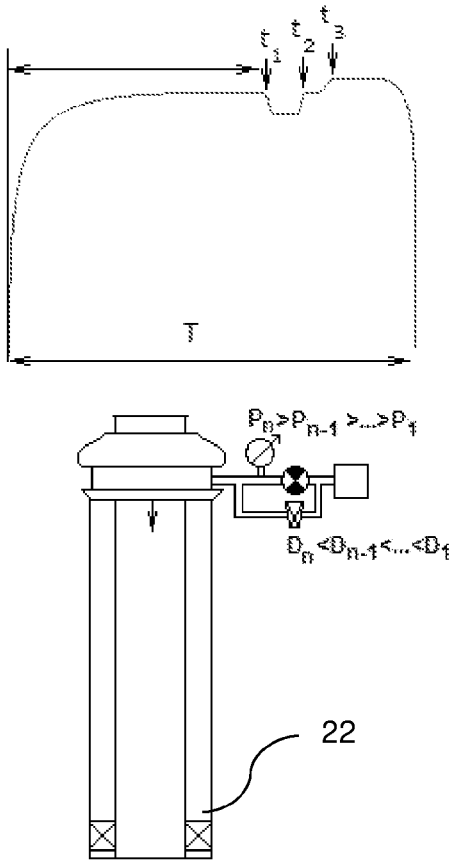

FIGS. 4*a* and 4*b* depict an illustration of the method of the present invention describing steps of detecting formation pressure based on interrupting the natural process of formation of a gas kick. As the gas comes out of formation and forms into a gas kick, it enters the well at the very bottom. Once the gas is in the well, the upper end of the gas kick is formed, while the lower end is still absent—as more gas continues to enter the well. An incompletely formed gas kick presents an opportunity to accurately measure the formation pressure which is described in the present invention and illustrated in FIGS. 4*a* and 4*b*.

The process starts at the moment of detecting the initial formation of the gas kick. FIG. 4*a* lower part shows the upper end of the gas kick 20 with upper part showing appearance of a pressure disturbance t1 in the pressure curve P. Initial conditions of mud pressure P1 and the value of the bypass resistance D1 are recorded along with known depth of the oil well at that point and the real-time density of the drilling mud.

As opposed to the previous devices, the present invention features a remotely-adjustable bypass restrictor 10 in a bypass line of the valve 8. Restrictor 10 may be characterized by an adjustable diameter D. Initially, restrictor 10 is open to its maximum capacity characterized by a first diameter D1.

When a negative pressure wave is sent down the well at this point by abruptly opening valve 8 for example, an inverted chart of the received signal may look like the one shown in the upper part of FIG. 4*a*—with the characteristic points of interest of t1 (upper end) and t3 (formation point) clearly present but t2 (lower end of the gas kick) being absent. Formation pressure at this point exceeds well pressure and so more gas continues to enter the well increasing the volume of the gas kick.

Once such condition is detected (by periodically monitoring acoustic response of the system as described above), an automatic sequence of steps may be taken in order to determine precisely the level of formation pressure as described below.

Step a. Abruptly changing fluid pressure from a first pressure level to a second pressure level to generate a pressure shock wave. Periodic generation of a negative pressure wave (for example by abruptly opening valve 8 with restrictor 10 in fully opened position characterized by a first diameter D1) is used in order to monitor for initial appearance of an incompletely formed gas kick, as indicated by presence of gas kick upper end and absence of gas kick lower end.

Step b. Maintaining fluid pressure at the second pressure level for a period of time sufficient to allow the pressure shock wave to travel down along the well, reflect from a well bottom, and ascend upwards. In embodiment, the duration period of the shock wave may be chosen to be suitable in order for the multiple reflections of the generated signal to subside, for example about 10-15 seconds.

Step c. Monitoring the output fluid pressure as a function of time from the onset of change in fluid pressure (opening of valve 8) and during the time of the pressure shock wave traveling down and then up along the oil well.

Step d. Detecting a presence of an upper end of the gas kick using a pressure peak in the fluid pressure and absence of a lower end thereof. Record well head pressure P1 at the time of detecting presence of upper end of the gas kick.

When initial formation of a gas kick is detected, all drilling is stopped, BOP 4 is closed and the drilling mud pump output may be reduced, but not stopped. Reduction of pump flow to about 10% of its nominal value allows to slow down the ascending gas kick and increase the time available for taking countermeasures against it. The pump needs to continue its operation in order to maintain pressure in the well.

Step e. Repeating steps (a) through (d) at higher successive pressures until detecting presence of a lower end of the gas kick. This may be accomplished by increasing flow resistance, for example by decreasing diameter D to a second value D2, in increments of 1 mm at a time. Decreased flow of mud will cause increase in well head pressure and respectively well pressure overall, including well pressure at the bottom of the well. Stepwise increase of mud pressure in increments of about 1 to 5 atmospheres may be used to accurately characterize the formation pressure.

Generating a series of negative pressure waves at successively higher pressures, such as by closing and then abruptly opening valve 8 with the restrictor 10 set at successively smaller diameters D2 may be done to collect a series of pressure wave signatures of reflected acoustic waves. Successive pressure shock waves may be generated every 20-60 seconds or as soon as the previous wave has sufficiently diminished so as to not affect the next one. The goal here is to generate several (3 to 10) successive negative pressure shock waves in a short period of time of several minutes in order to ascertain formation pressure as quickly as possible. This is helpful in minimizing the volume of the ascending gas kick.

If the same initial pressure wave signature is present (presence of t1 and t3, absence of t2), repeat steps 3 and 4 of decreasing diameter Dn further by predefined steps such as 1 mm at a time and measuring increasing pressure Pn—until a situation in which good reflection of the lower end 22 of the gas kick is established and t2 is clearly observed—see FIG. 4*b*. Increasing well pressure at the well head by increasing resistance to flow in the bypass line will eventually cause sufficient increase in well pressure at the bottom so as to suppress formation overpressure and reduce and ultimately stop incoming gas and complete formation of the gas pack—so its lower end is clearly visible on the pressure wave as indicated by t2.

Step f. Calculating formation pressure using said higher pressure Pn from step (e) recorded upon detecting said lower end of the gas kick from the presence of t2, well depth and fluid column weight therein. Since the gas pack velocity is very slow in the beginning, there is sufficient time available to determine formation pressure this way, and it will be very precise.

Once formation pressure is determined, density of the drilling mud may be adjusted such that column pressure and pump pressure together are adjusted to be even or slightly higher than formation pressure. Knowing the formation pressure accurately allows calculating the necessary adjustment to the density of the drilling mud in order to wash out the gas kick. If the chosen density of the mud is not high enough, it will not be able to stop formation of the gas pack at the bottom hole, and may cause a full-fledged blowout and explosion. If the density of the mud is too high, it may cause hydro fracturing of the formation, in which case the mud will escape into the fractured formation, increasing the flow of gas into the well, and again causing a blowout and an explosion. The proper density need to be selected to overcome the formation pressure slightly while at the same time preventing hydraulic fracture of the well.

Detection of Hydrogen Sulfide in a Gas Kick

The methods of detecting hydrogen sulfide gas (H2S) or carbon dioxide gas (CO2) inside gas packs are based on their respective higher solubility in fluids compared to hydrocarbon gases.

Under typical conditions, hydrogen gas such as natural gas enters the well pipe from the bottom of the well when formation pressure exceeds the well pressure. This can be detected using methods described above.

In case H2S or CO2 is present in the fluids entering the well, such gases will remain in solution until the pressure of the fluid drops to levels low enough for these gases to come out of solution and form a gas kick. Due to their higher solubility, the pressure level when H2S or CO2 come out of liquid solution is lower and therefore this process may happen higher up the well rather than an it's very bottom.

Because the gas pack appears further up in the well, this leaves less time to react and to introduce countermeasures, and in case of blowout can cause higher losses in terms of human lives, environmental damage and equipment loss, since hydrogen sulfide gas is poisonous and corrosive.

This physical phenomenon presents an opportunity to detect possible presence of hydrogen sulfide or carbon dioxide in the gas pack ascending to the surface of the well. In embodiments, continuous monitoring of the acoustic signature generated by periodic generation of the negative pressure shock waves may be employed to assure no gas kicks are forming or traveling through the well. Normal acoustic signature may be seen in FIG. 2*a* or 3*a*, where only t3 point of pressure disturbance is present indicating reflecting of the pressure wave off the bottom of the well.

If a sudden appearance of a well formed gas kick is detected and calculated to be at a depth other than the bottom of the well, and if in that case both the upper end and the lower end of the gas kick are well defined (as indicated by points t1 and t2—seen in FIG. 2*c* or 3*c* for example), a hydrogen sulfide or carbon dioxide gas bubble is immediately suspected. This may be confirmed by absence of any indication of a gas kick at previous recordings of the pressure waveforms, indicating that a gas bubble is formed at lower fluid pressures than that typically associated with natural gas. While it may be difficult to distinguish between hydrogen sulfide and carbon dioxide in this case, assumption needs to be made that it is H2S and not CO2 and compensation measures needs to be activated right away.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, Aft AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, Aft BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A method for detecting formation pressure at a time of appearance of a gas kick entering a well comprising the steps of:

a. abruptly changing fluid pressure from a first pressure level to a second pressure level to generate a pressure shock wave, b. maintaining fluid pressure at said second pressure level for a period of time sufficient to allow said pressure shock wave to travel down along said well, reflect from a well bottom, and ascend upwards, c. monitoring said fluid pressure as a function of time from the onset of said change in fluid pressure and during the time of said pressure shock wave traveling down and then up along said well, d. detecting a presence of an upper end of said gas kick using a pressure peak in said fluid pressure and absence of a lower end of said gas kick, e. repeating steps (a) through (d) at higher successive pressures until detecting presence of a lower end of the gas kick, and f. calculating formation pressure using said higher pressure from step (e) recorded upon detecting said lower end of the gas kick, well depth and fluid column weight therein.

2. The method as in claim 1, wherein said fluid is a drilling mud and said fluid pressure is an outlet pressure of said drilling mud exiting said well.

3. The method as in claim 1, wherein said second pressure level is lower than said first pressure level, whereby said pressure shock wave is a negative pressure shock wave.

4. The method as in claim 1, wherein said step (b) of maintaining said fluid pressure at said second level is maintained for a period of time to allow said pressure wave to reach a well bottom and return to a well head, said fluid pressure being returned to said first level thereafter.

5. The method as in claim 1, wherein said step (a) is accomplished within a time period of about 1/20 to about 1 second.

6. The method as in claim 1, wherein the difference between said first pressure and said second pressure is about 1 to about 5 atmospheres.

7. The method as in claim 1, wherein said higher successive pressures in step (e) are selected in increments of about 1 to 5 atmospheres.

8. The method as in claim 1 further including a step of adjusting the fluid density so as to assure bottom well pressure to be at or above formation pressure as determined in step (f).

9. The method as in claim 1, wherein step (d) further including reducing output from a drilling mud pump, whereby slowing down a speed of ascending for said gas kick.

10. The method as in claim 9, wherein said drilling mud pump output is reduced to about 10 percent of normal level.

* * * * *